US008213269B2

(12) United States Patent
Saunier

(10) Patent No.: US 8,213,269 B2
(45) Date of Patent: Jul. 3, 2012

(54) TIMEPIECE WITH DIAL HAVING A ROTARY INDEX

(75) Inventor: André Saunier, Vers-les-Rochets (CH)

(73) Assignee: Paul Hartzband, Chappaqua, NY (US)

( * ) Notice: Subject to any disclaimer, the term of this patent is extended or adjusted under 35 U.S.C. 154(b) by 153 days.

(21) Appl. No.: 12/811,606

(22) PCT Filed: Mar. 30, 2009

(86) PCT No.: PCT/EP2009/053762

§ 371 (c)(1),
(2), (4) Date: Sep. 30, 2010

(87) PCT Pub. No.: WO2009/121851

PCT Pub. Date: Oct. 8, 2009

(65) Prior Publication Data

US 2011/0013495 A1 Jan. 20, 2011

(30) Foreign Application Priority Data

Apr. 1, 2008 (CH) ..... 490/08

(51) Int. Cl.
*G04B 19/16* (2006.01)

(52) U.S. Cl. ..... 368/231; 368/225

(58) Field of Classification Search ..... 368/231, 368/225, 233

See application file for complete search history.

(56) References Cited

U.S. PATENT DOCUMENTS

| | | | | | |
|---|---|---|---|---|---|
| 319,804 | A | * | 6/1885 | Ethridge | 368/231 |
| 347,337 | A | | 8/1886 | Ethridge | |
| 393,000 | A | * | 11/1888 | Ethridge | 368/231 |
| 400,734 | A | * | 4/1889 | Bickford | 368/231 |
| 401,697 | A | * | 4/1889 | Ethridge | 368/231 |
| 403,525 | A | * | 5/1889 | Ethridge | 368/231 |
| 2,723,527 | A | * | 11/1955 | Smith | 368/233 |
| 3,404,527 | A | * | 10/1968 | Tripet et al. | 368/231 |
| 5,687,140 | A | * | 11/1997 | Sekine et al. | 368/231 |

FOREIGN PATENT DOCUMENTS

| | | |
|---|---|---|
| CH | 23760 | 9/1902 |
| CH | 55 779 | 9/1912 |
| CH | 83 150 | 11/1919 |
| CH | 311 295 | 11/1955 |
| CH | 453 216 | 9/1967 |
| CH | 684814 | 1/1995 |
| DE | 14 60 017 | 3/1939 |
| FR | 890 586 | 2/1944 |
| FR | 1 114 341 | 4/1956 |
| WO | 2008/144948 | 12/2008 |

OTHER PUBLICATIONS

International Search Report dated Jul. 10, 2009, from corresponding PCT application.

Swiss Search Report dated Feb. 17, 2009, from corresponding Swiss application.

* cited by examiner

*Primary Examiner* — Sean Kayes
(74) *Attorney, Agent, or Firm* — Young & Thompson

(57) ABSTRACT

A timepiece includes: a frame (10) defining a housing designed to accommodate a timepiece movement; and a dial (14) positioned on the frame and defining a plane, the dial including at least one opening (16) whose dimensions are such as to allow at least one index (18) mounted rotationally on the frame to be seen.

12 Claims, 7 Drawing Sheets

TIMEPIECE WITH DIAL HAVING A ROTARY INDEX

TECHNICAL FIELD

The present invention relates to the horology field. It more particularly concerns a timepiece comprising:

- a frame defining a housing designed to receive a timepiece movement, and
- a dial positioned on the frame and defining a plane, the dial including at least one opening, dimensioned so as to leave at least one index mounted rotationally on the frame to be visible.

BACKGROUND OF THE INVENTION

Document CH684814 discloses a timepiece as defined above, in which the rotary indexes are mounted pivoting along axes situated parallel in reference to the plane defined by the dial. According to this document, the indexes are of the prismatic type and have several faces, designed either to be displayed or hidden. When a face of the prism is displayed, it is completely visible in the opening of the dial. This device in particular has the drawback of requiring a relatively significant thickness, such that the prism can be housed and can pivot. Moreover, during pivoting of the prisms, the openings of the dial can be partially gaping, depending on the shape of the prisms, which can be considered not very esthetically pleasing.

The present invention aims to propose a timepiece whereof the dial makes it possible to present several visual appearances, which a user can show as desired, while also resolving the aforementioned drawbacks.

BRIEF DESCRIPTION OF THE INVENTION

More precisely, the invention concerns a timepiece as defined in the first paragraph above, characterized in that the index is mounted rotating along an axis essentially perpendicular to the plane of the dial and having a display surface situated on the dial side, oriented along a plane essentially parallel to that of the dial. A fitting is positioned so as to partially cover the display surface, dividing said display surface in a first hidden portion and a second visible portion. The timepiece also comprises a control organ capable of being actuated by a user, associated with kinematic transmission means connecting the control organ and the index, such that an action on the control organ drives the rotation of the rotary index, so that the visible portion becomes hidden and at least the main part of the hidden portion becomes visible.

Other advantageous features of the invention are defined in the dependent claims.

BRIEF DESCRIPTION OF THE DRAWINGS

Other features of the present invention will appear more clearly upon reading the description that follows, done in reference to the appended drawing, in which.

DETAILED DESCRIPTION OF THE INVENTION

Figure 1:
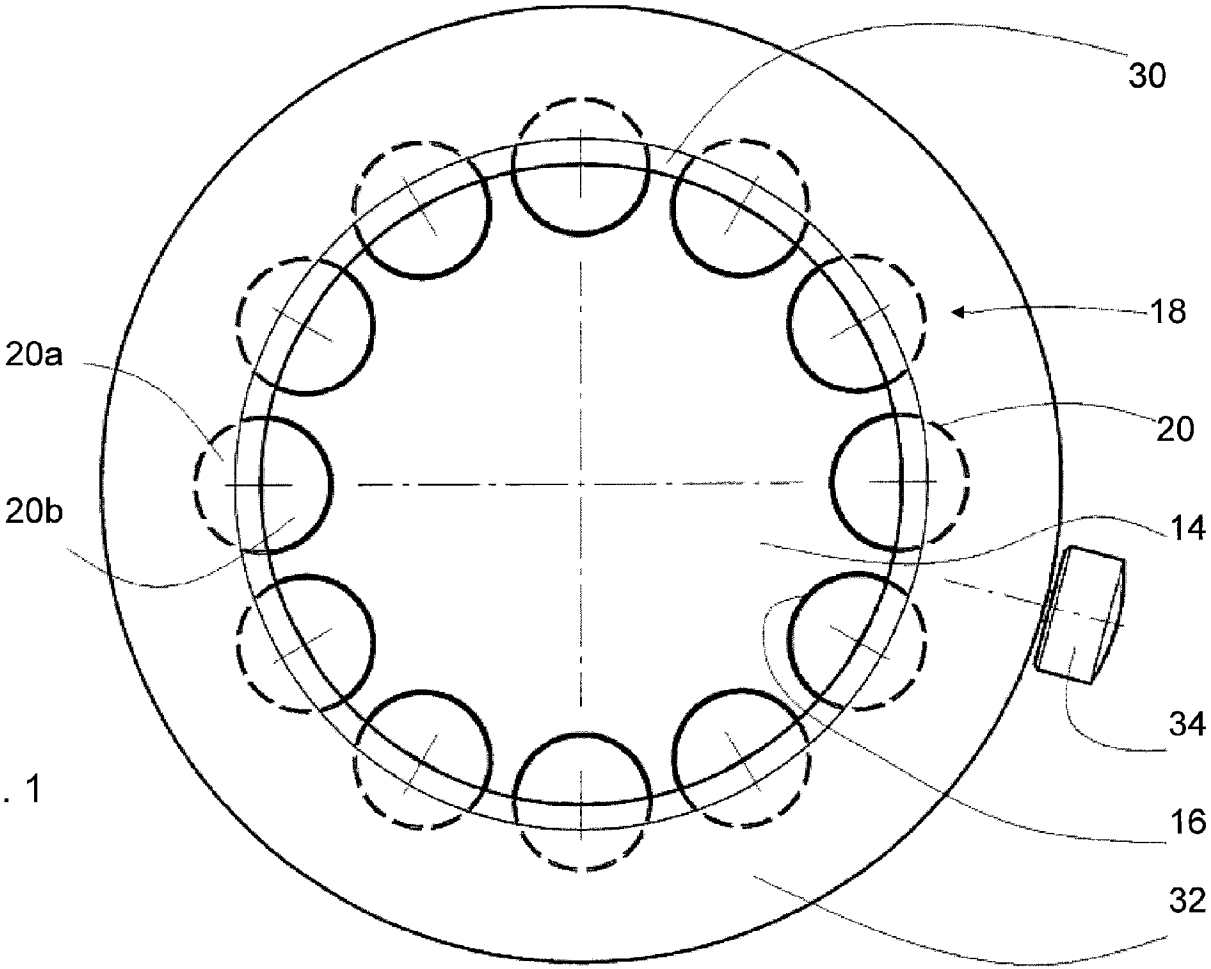
FIG. 1 is a top view of a timepiece according to a first embodiment.

FIG. 1 diagrammatically shows a timepiece according to the invention, provided with a frame 10 defining a housing designed to receive a timepiece movement 12, positioned by one rim 13, visible in the figures in cross-section. The movement is fastened to the frame 10 conventionally, for example using a system of case screws, not shown.

Commonly, a dial 14 defining a plane is positioned on the frame 10 so that the movement 12 is not visible and to provide guide marks making it possible to display time information in cooperation with mobile elements driven by the movement, such as hands. In conventional dials, it is usual to have twelve indexes, regularly distributed on the periphery of the dial, in order to allow the reading of the time in reference to the position of the mobile elements.

According to the invention, the dial 14 includes twelve openings 16, preferably circular in shape, centered on the spokes on which the indexes are usually placed. The openings 16 are dimensioned so as to allow at least one index 18, provided with a display surface 20, mounted rotationally on the frame as will be described later, to be visible. As visible in FIG. 2, in this embodiment, the openings 16 allow the passage of the entire display surface 20 of the index.

Figure 2:
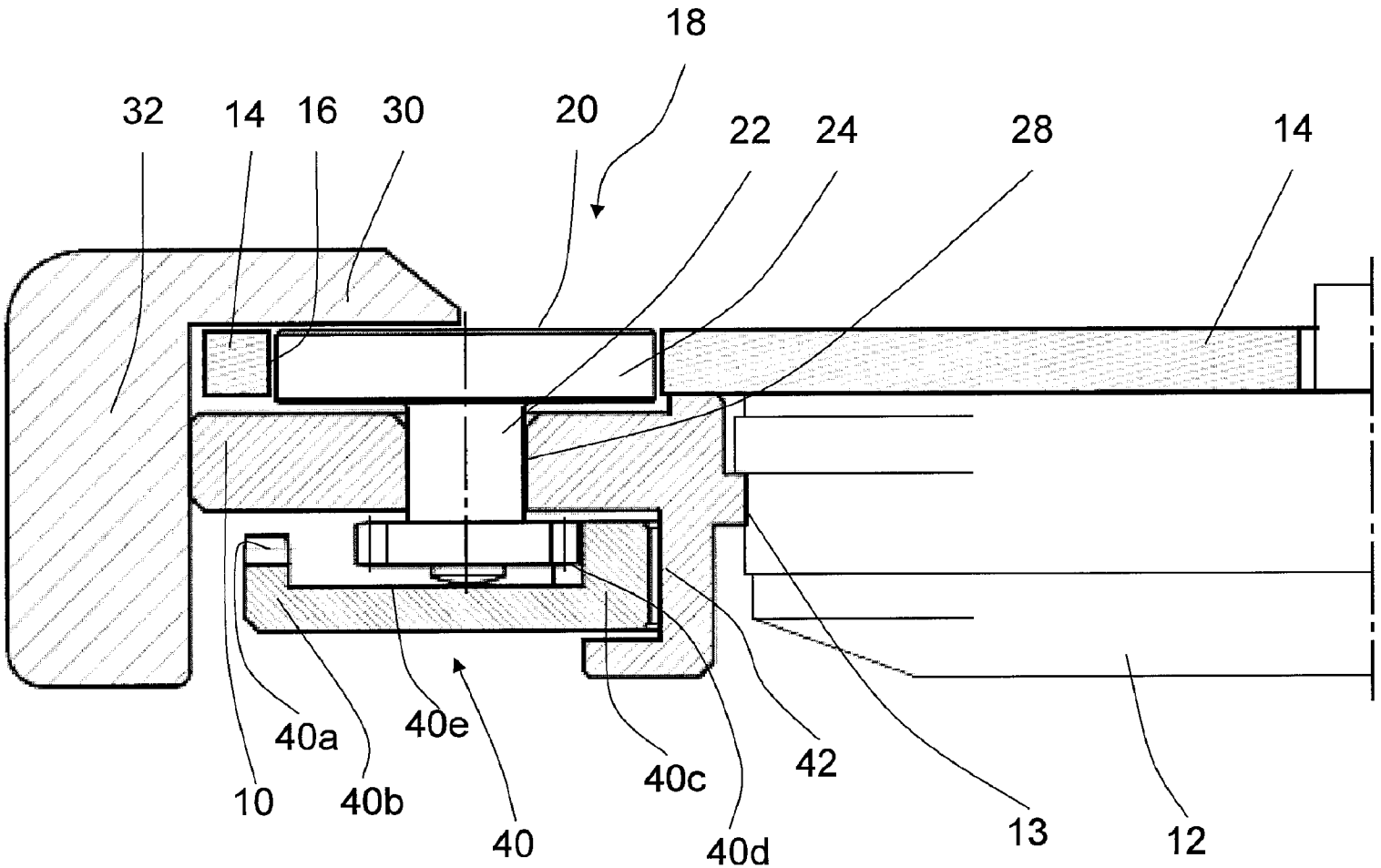
FIGS. 2, 3 and 4 are cross-sectional views, along different axes, of the timepiece of FIG. 1, FIGS. 5 and 6 are top and cross-sectional views, respectively, of a timepiece according to a second embodiment.

In reference to FIG. 2 showing a cross-section passing through the center of the display surface 20 of an index, these indexes 18 being rotationally mounted along an axis essentially perpendicular to the plane of the dial. Their display surface 20 is situated on the dial side and is oriented along a plane essentially parallel to that of the dial 14.

We will now describe the pivoting of the indexes 18. Each index includes an axis 22 provided, integral with a first of its ends, with a plate 24 whereof the surface situated on the side opposite the axis forms the display surface 20. The axis 22 is again provided, integral at its second end, with a pinion 26. The latter part is essentially parallel to the plate 24 and these two elements are perpendicular to the axis 22. This axis 22 is situated in a bore 28 formed in the thickness of the frame 10, so as to be able to turn freely therein. In this embodiment, the axis 22 is dimensioned such that the display surface 20 is flush with the upper surface of the dial 14, visible by the user. The plate 24, on one hand, and the pinion 26, on the other, sandwich the frame 10, thereby ensuring the positioning of the display surface.

According to the invention, a fitting 30 is positioned so as to partially cover the display surface 20 of the indexes 18. This fitting 30 divides the display surface 20 into a first hidden portion 20*a* and a second visible portion 20*b*. In the embodiment of FIG. 2, the fitting 30 is obtained by a rim presented by the watch case 32, typically its middle. The rim passes essentially through the center of the display surface 20, the two portions 20*a* and 20*b* being essentially equal. It can be made in a single piece or attached on the middle.

The aim of the invention is to make it possible to show, as desired, one or the other of the portions 20*a* and 20*b*, the other being hidden. The indexes can therefore evolve between a first position, in which the portion 20*b* of their display surface is visible, the other 20*a* being hidden, and a second position, in which the portion 20*b* visible in the first position is hidden, and the portion 20*a* hidden in the first position is essentially visible.

One will note that, in the second position, the portion hidden in the first position is only essentially visible because, for the timepiece to keep a normal appearance, the fitting 30 is circular in shape, like a normal bezel of a round watch case. Because of this, there is a zone of the display surface 20, essentially situated on a diameter of the surface separating the two portions, that remains hidden in the two positions the indexes can assume 18.

This arrangement can allow particularly interesting design play, in particular by showing numerical indexes or making them disappear in order to have a more harmonious design on the dial, without the indexes disrupting it.

Figure 3:
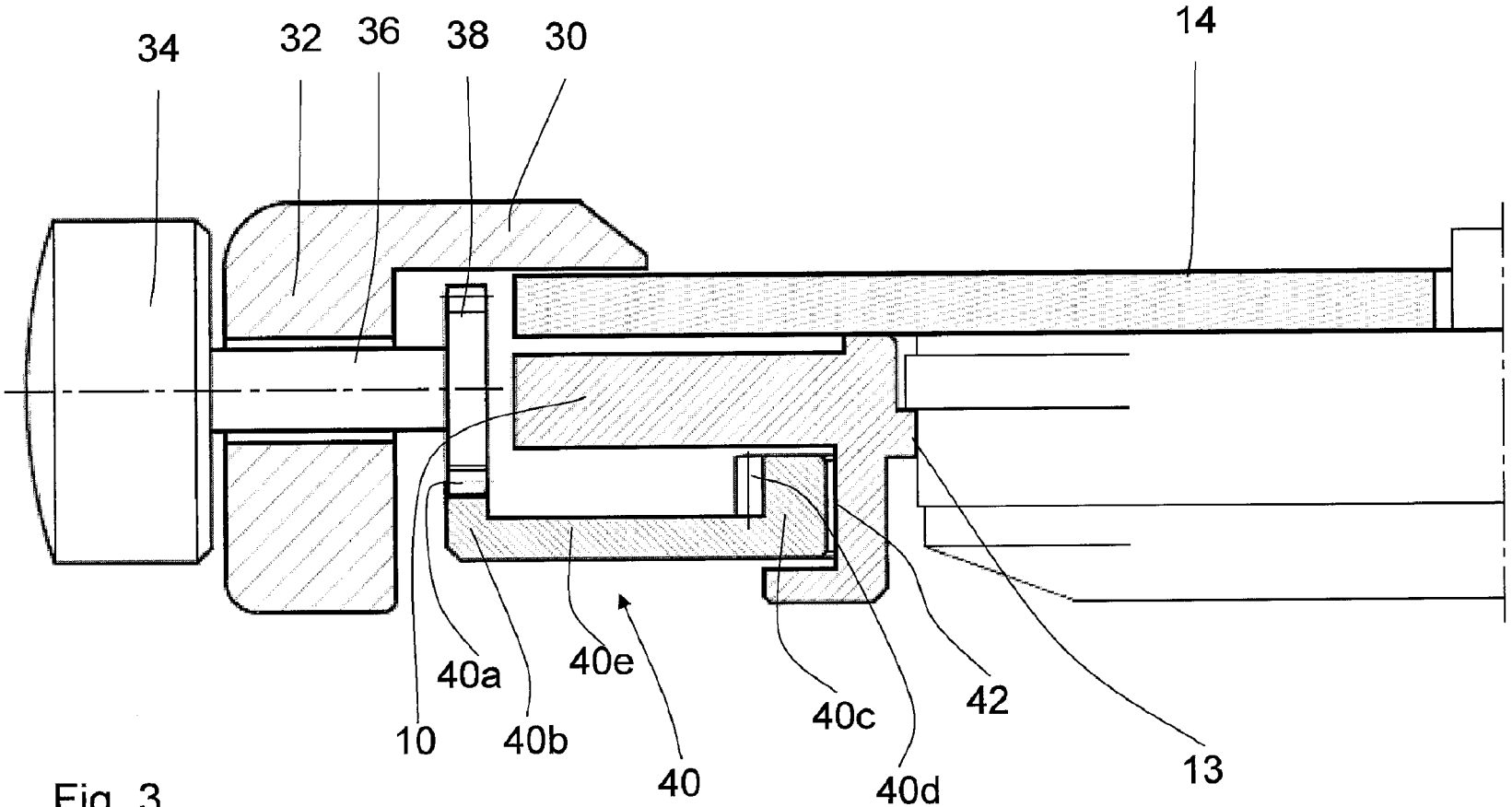

To drive the rotation of these indexes 18, the timepiece proposes a control organ, visible in FIG. 3, accessible from the outside of the timepiece by the wearer of the watch, and kinematically connected to the indexes by kinematic transmission means. One will note that FIG. 3 is a cross-section along an axis passing through the control organ. According to the embodiment illustrated in the figures, the control organ assumes the form of a button 34 capable of being driven in rotation, like a winding stem crown.

In a more detailed manner, the button 34 is mounted on a stem 36 parallel to the plane of the dial 14 and passing through the watch case. The end of the stem 36 situated inside the case supports a toothed wheel 38, meshing with a first toothing 40*a* of a crown 40. The latter part is positioned around the movement 12, parallel to the frame 10 and is capable of pivoting around the movement 12. The crown 40 is guided in rotation and is positioned owing to a groove 42 included by the frame 10, formed on an extension 10*a* of the frame, extending toward the bottom of the movement.

Preferably, the first toothing 40*a* of the crown 40 is formed horizontally in reference to FIG. 2, on a first rim 40*b* of the crown 40. The meshing conditions of the first toothing 40*a* with the toothed wheel 38 are thus optimal. One will note that a perpendicular meshing could also be used.

The crown 40 also includes a second rim 40*c*, situated on the side of the crown 40 of smallest radius. This second rim 40*c* has a second toothing 40*d*, positioned vertically, in reference to FIG. 3. This second toothing 40*d* is engaged with the pinions 26 of the indexes.

The crown 40 therefore has first 40*a* and second 40*d* toothings, situated on either side of a bottom 40*e*, which can advantageously participate in the positioning and guiding of the indexes 18. Thus, the bottom 40*e* of the crown can serve as a support for the axis 22 of the indexes, as one can see in FIG. 2.

To optimize the operation of a timepiece according to the invention, it is advantageous to control or even limit the rotation of the indexes 18, so that the portions 20*a* and 20*b* defined by the fitting 30 indeed pass alternatingly from the hidden position to the visible position, avoiding finding themselves in intermediate positions. The rotation of the indexes 18 being controlled by the control organ via the rotation of the crown 40, it is advantageous to control the rotation of all of the indexes 18 by acting on the rotation of the crown 40, which is easier than acting on the rotation of the button 34.

Figure 4:
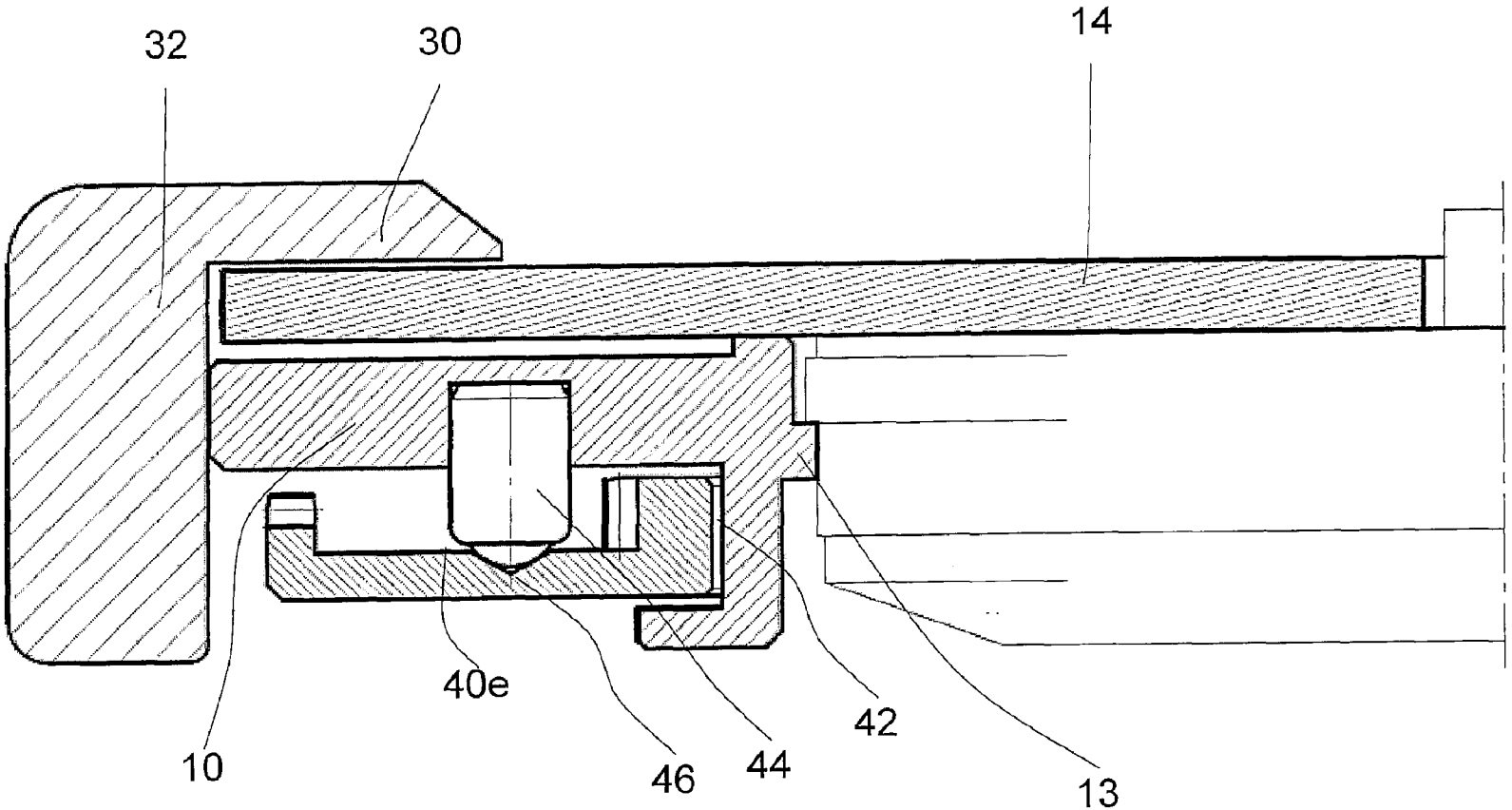

To do this, the crown therefore includes organs limiting the rotation of the indexes. In this aim, the rotation of the crown 40 is controlled, as shown by FIG. 4, owing to an element 44, such as a pin, positioned protruding on the frame 10 and cooperating with a recess 46 formed in the bottom 40*e* of the crown 40, the recess 46 having a circular arc shape, concentric to the crown 40. The length of the recess 46 is defined so as to have a desired rotation of the indexes 18, the element 44 only being able to move inside the recess 46. Preferably, as in the illustrated embodiment, the rotation of the indexes 18 is in the vicinity of 180°. The person skilled in the art can also provide for forming a notch, allowing the user to feel when the controlled positions of the indexes are reached. For example, he can mount the element 44 on a spring system, making it possible to realize the notch while cooperating with a relief of the recess. The element can then be a spring loaded ball, mounted mobile at the end of a tube. In that case, it is possible to allow the user to turn the button 34 without limitation, in one direction or the other, the user simply feeling the notches when the indexes are in the desired position. One will note that, for safety, a friction or torque limiting system can be inserted between the button 34 and the crown 40 such that, when the crown is immobilized in rotation, breakage is avoided if the user forces the button.

Thus, in operation, the indexes 18 are capable of evolving between

- a first position, in which one portion 20*b* of their display surface is visible, the other 20*a* being hidden, and
- a second position, in which the portion 20*b* visible in the first position is hidden, and the portion 20*a* hidden in the first position is essentially visible.

When the indexes 18 are in their first position, the wearer can actuate the button 34 by pivoting it in a first direction. The toothed wheel 38 will then drive the rotation of the crown 40, through the first toothing 40*a*. The crown 40 then drives the rotation of the indexes 18, by meshing of the second toothing 40*d* with the pinion 26 of each index 18.

When the protruding element 44 has reached the end of the recess 46, the indexes 18 have pivoted so as to be found in the second aforementioned position. The rotation of the crown 40 is thus stopped. Reverse actuation on the button 34 makes it possible to bring the indexes 18 back from their second to their first position.

Alternatively, with a notch positioning system, the indexes have reached their second position when the mobile element assumes its position in the relief of the recess. The return of the indexes to their first position can be done either by reverse rotation of the button 34, or by continuing the rotation of the button in the same direction and bringing the mobile element into a following relief included in the recess.

Figure 5:
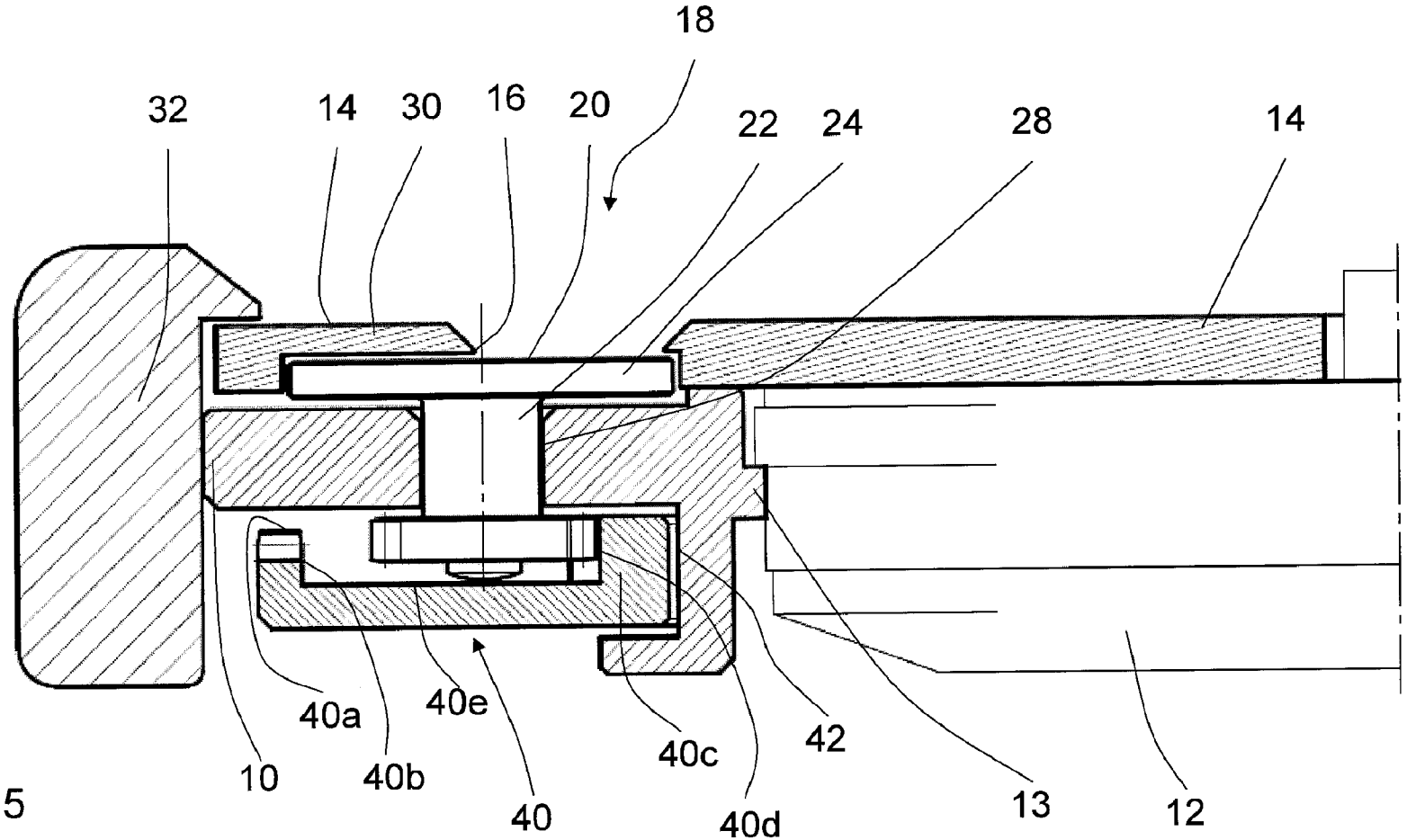
Figure 6:
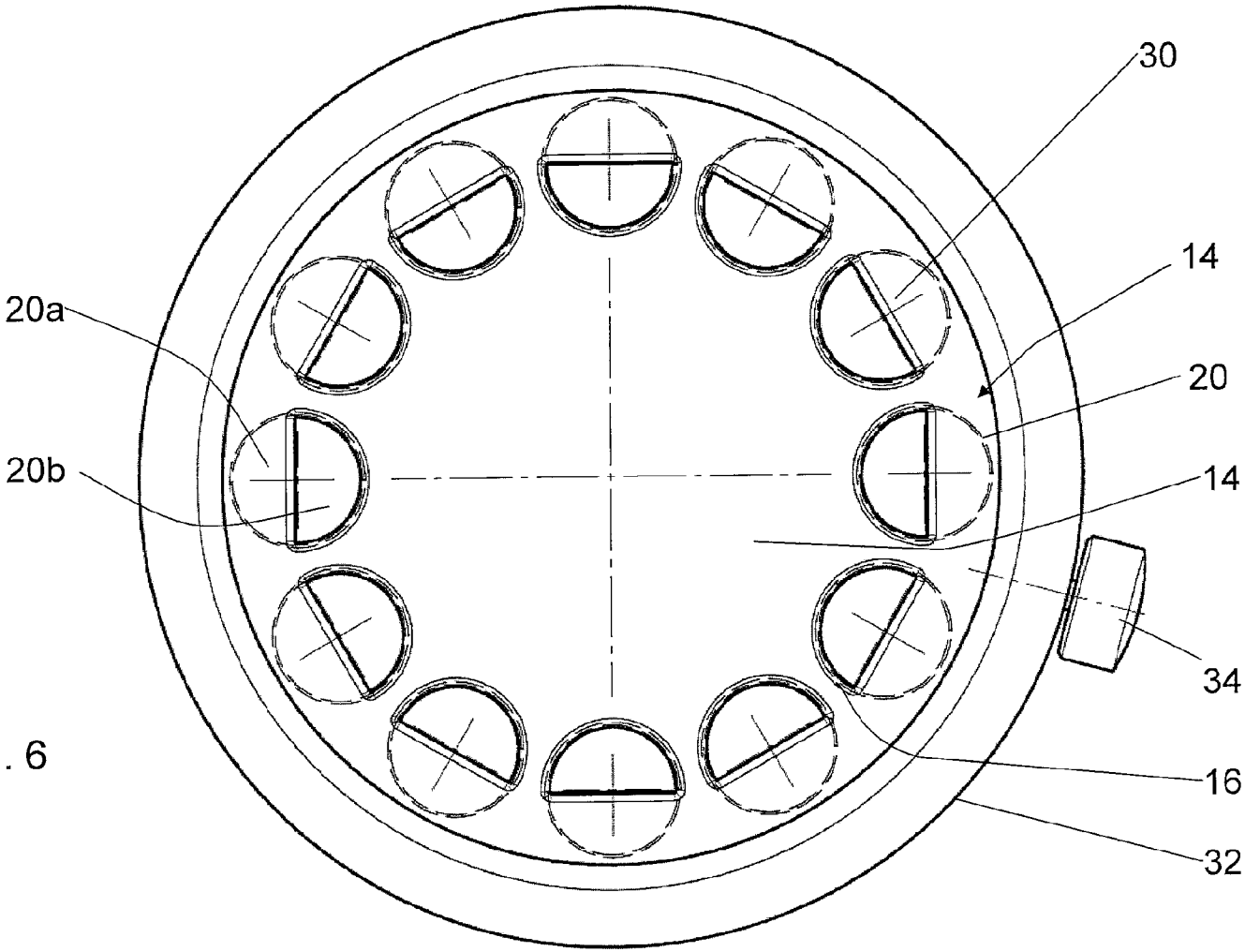

FIGS. 5 and 6 propose a second embodiment, differing from the first by the realization of the fitting 30. The openings 16 formed in the dial 14 are dimensioned so as to leave each index 18 visible, but only partially, such that the dial 14 itself defines the fitting 30. This arrangement has the advantage of allowing more latitude in terms of the shape of the openings 16 and fittings 30, without harming the overall esthetics of the piece. Thus, the openings 18 can be perfectly semi-circular, dividing the display zone 20 into two equal half-circles. This embodiment can also allow one to consider having the fitting 30 cover only one sector of 360/N degrees, the display surface 20 being divided into N equal portions, successively appearing or not appearing on the dial. In this case, the display surfaces can even not be circular and have a regular polygon shape. The marking of the different positions of the crown 40 by notch is then very useful to mark the successive positions assumed by the indexes 18. In this embodiment, one will note that the display surface 20 is situated at a slightly lower level in reference to the surface of the dial. The latter part can have a shoulder slightly covering the index, in order to participate in its positioning. One will also note that, to optimize the thickness occupied by the indexes, the plate 24 can be positioned, partially or totally, in the thickness of the dial 14.

Figure 7:
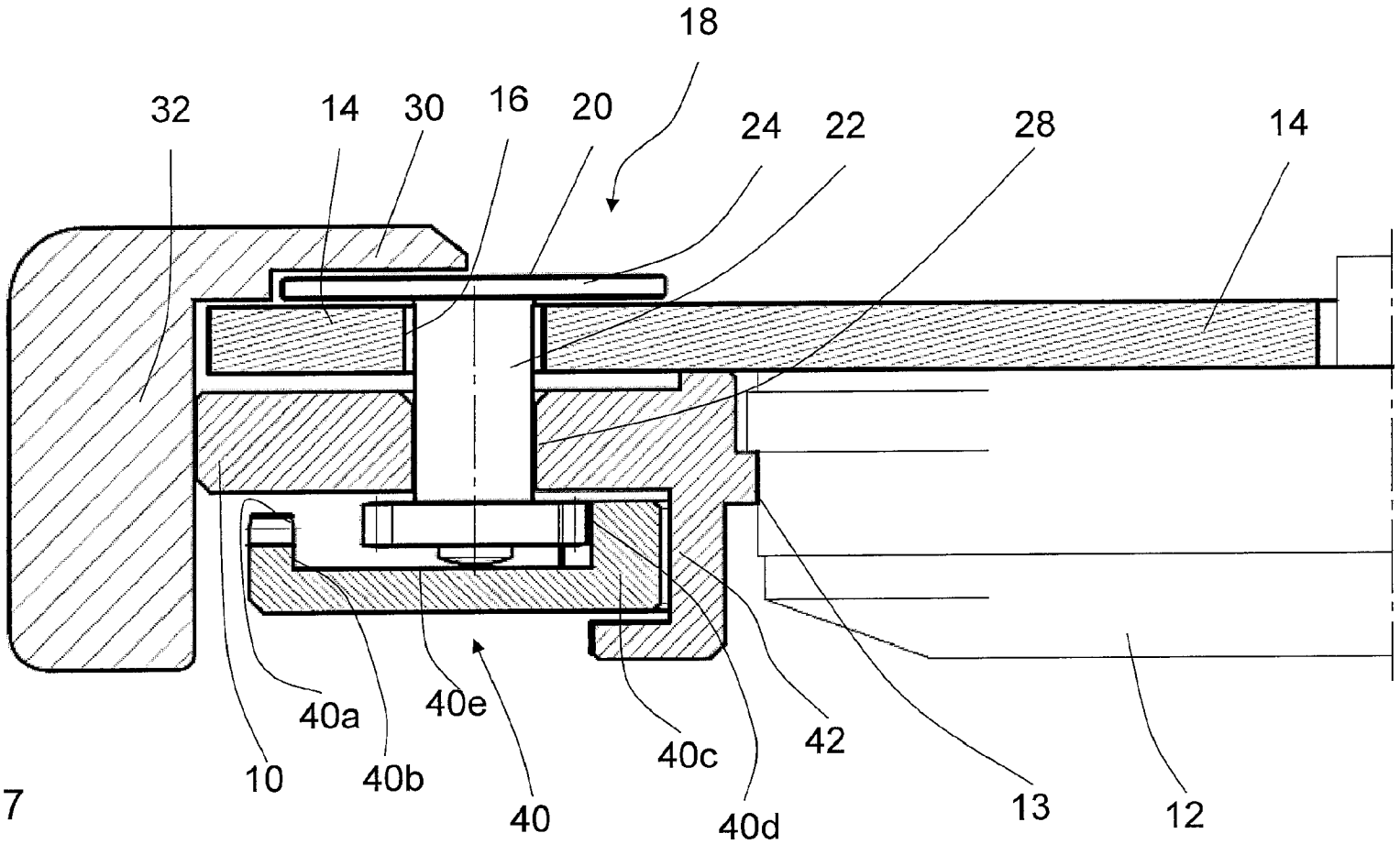
FIG. 7 is a cross-sectional view of a timepiece according to a third embodiment.

FIG. 7 shows an additional alternative, in which the display surface 20 of the indexes 18 is situated at a slightly higher level relative to the surface of the dial. It is, like in the first embodiment described, elements of the case 32 that make up the fitting 30.

The description above was provided as a non-limiting illustration of the invention. Thus, it is of course not necessary to have twelve rotary indexes. There can very well only be one or an indifferent number. Moreover, the illustrations show circular dials, which is indeed advantageous for the realization of the invention. One will note, however, that the second embodiment makes it possible to have a square or rectangular dial or case, in which the ring is placed.

Moreover, the organ for controlling the rotation of the indexes may not be a button capable of being driven in rotation. The person skilled in the art will know how to arrange other control organs capable of setting the crown in rotation. This rotation can be obtained by a bolt sliding in the edge of the case, the bolt being associated with a toothed sector. A push-piece cooperating with a ratchet or a rack can also be used.

The invention claimed is:

1. A timepiece comprising a frame defining a housing designed to receive a timepiece movement, and a dial positioned on the frame and defining a plane, the dial including at least one opening, dimensioned so as to leave visible at least one index mounted rotationally on the frame along an axis essentially perpendicular to the plane of the dial and having a display surface situated on the dial side, oriented along a plane essentially parallel to that of the dial, a fitting positioned so as to partially cover the display surface and divide it into a first hidden portion and a second visible portion, the timepiece comprises a control member, associated with kinematic transmission means connecting the control organ and the index, such that an action on the control organ drives the rotation of the rotary index, so that the first portion (20*a*) becomes hidden and at least the main part of the second portion (20*b*) becomes visible, wherein the display surface of the index can be arranged at a level selected from:

a level where said display surface is flush with the upper surface of the dial, and a level where said display surface is situated at a slightly higher level relative to the visible surface of the dial.

2. The timepiece of claim 1, comprising a plurality of rotary indexes, each associated with a fitting, driven by said control organ, via the kinematic transmission means.

3. The timepiece of claim 1, wherein the kinematic transmission means include organs limiting the rotation of the indexes.

4. The timepiece according to claim 3, wherein an element is positioned protruding on the frame and is arranged so as to cooperate with a recess formed in the crown, said recess having a circular arc shape, concentric to the crown.

5. The timepiece of claim 1, wherein the fitting covers a sector of 360/N degrees, the display surface being divided into N equal portions.

6. The timepiece of claim 1, wherein the control organ is capable of being actuated by a user, such that a manual action on the control organ drives the rotation of the rotary index.

7. The timepiece of claim 6, wherein the control organ is a button mounted mobile in rotation along an axis parallel to the plane of the dial.

8. The timepiece of claim 6, wherein the control organ is a button mounted mobile in rotation along an axis parallel to the plane of the dial.

9. The timepiece of claim 1, wherein the kinematic transmission means comprise a crown presenting first and second toothings, meshing respectively with a toothed wheel driven in rotation by the control member, and with a pinion integral in rotation with the display surface.

10. The timepiece according to claim 9, wherein an element is positioned protruding on the frame and is arranged so as to cooperate with a recess formed in the crown, said recess having a circular arc shape, concentric to the crown.

11. The timepiece of claim 10, wherein the control organ is capable of being actuated by a user, such that a manual action on the control organ drives the rotation of the rotary index.

12. The timepiece of claim 9, wherein the index includes axis provided, integral at a first of its ends, with a plate whereof the surface situated on the side opposite the axis forms the display surface, said axis again being provided, integral at its second end, with said pinion meshing with the second toothing.

* * * * *